US009314107B2

(12) United States Patent
Fornoff et al.

(10) Patent No.: US 9,314,107 B2
(45) Date of Patent: Apr. 19, 2016

(54) SUPPORTING SPRING SYSTEM FOR A MATTRESS IN PARTICULAR

(71) Applicant: Thomas Beteiligungs- Und Vermogens-GmbH & Co. KG, Bremervorde (DE)

(72) Inventors: Dieter Fornoff, Darmstadt (DE); Andreas Ries, Darmstadt (DE)

(73) Assignee: Thomas Beteiligungs— Und Vermögens-GmbH & Co. KG, Bremervorde (DE)

( * ) Notice: Subject to any disclaimer, the term of this patent is extended or adjusted under 35 U.S.C. 154(b) by 0 days.

(21) Appl. No.: 14/357,824

(22) PCT Filed: Nov. 13, 2012

(86) PCT No.: PCT/EP2012/004704

§ 371 (c)(1),
(2) Date: May 13, 2014

(87) PCT Pub. No.: WO2013/072036

PCT Pub. Date: May 23, 2013

(65) Prior Publication Data

US 2015/0001772 A1 Jan. 1, 2015

(30) Foreign Application Priority Data

Nov. 14, 2011 (DE) ..... 10 2011 118 357
May 15, 2012 (DE) ..... 10 2012 009 646

(51) Int. Cl.
*A47C 23/06* (2006.01)
*A47C 23/02* (2006.01)
(Continued)

(52) U.S. Cl.
CPC . *A47C 23/02* (2013.01); *A47C 7/28* (2013.01); *A47C 23/002* (2013.01); *A47C 23/06* (2013.01); *A47C 23/064* (2013.01)

(58) Field of Classification Search
CPC ..... A47C 7/28; A47C 7/025; A47C 7/285; A47C 23/002; A47C 23/02; A47C 23/06; A47C 23/064
See application file for complete search history.

(56) References Cited

U.S. PATENT DOCUMENTS 7,621,004 B2 * 11/2009 Lobry et al. ..... 5/238
2008/0185760 A1 8/2008 Jansen
2009/0126106 A1 5/2009 Lobry

FOREIGN PATENT DOCUMENTS

CN 1649530 A 8/2005
CN 102573573 A 7/2012
(Continued)

OTHER PUBLICATIONS

Electronic Translation of EP 1649786A1.*
(Continued)

*Primary Examiner* — Anna Momper
(74) *Attorney, Agent, or Firm* — Laurence P. Colton; Smith Tempel Blaha LLC

(57) ABSTRACT

Supporting spring systems for sleeping, reclining or sitting furniture must have spring characteristics that provide good sleeping, reclining and/or sitting comfort. In known supporting spring systems, this is achieved only by relatively high design expenditure. The invention aims to create a simple and flexible supporting spring system which nevertheless ensures high sleeping, reclining or sitting comfort. Support elements (13, 50, 60, 70, 80) for connecting two female connectors (10) of a pair of female connectors (11) are provided for this purpose. The support elements (13, 50, 60, 70, 80) exhibit spring arms (15, 72) that are guided from beneath the female connectors (10) of the pairs of female connectors (11) up around the outside of the pair of female connectors (11).

11 Claims, 5 Drawing Sheets

(51) Int. Cl.
*A47C 23/00* (2006.01)
*A47C 7/28* (2006.01)

(56) References Cited

FOREIGN PATENT DOCUMENTS

| | | | | |
|---|---|---|---|---|
| DE | 202005015266 | U1 | | 12/2005 |
| DE | 102009043009 | A1 | * | 3/2011 |
| EP | 0254702 | A1 | | 1/1988 |
| EP | 0852122 | A2 | | 12/1997 |
| EP | 0852122 | A2 | | 7/1998 |
| EP | 1013200 | A1 | * | 6/2000 |
| EP | 1649786 | A1 | * | 4/2006 |
| EP | 1927302 | A1 | * | 6/2008 |
| FR | 2914164 | A1 | | 10/2008 |
| WO | WO 2008148982 | A1 | * | 12/2008 |
| WO | WO 2010099921 | A2 | * | 9/2010 |

OTHER PUBLICATIONS

WIPO/PCT, International Search Report on parent application PCT/EP2012/004704, Feb. 7, 2013.
State Intellectual Property Office of the People's Republic of China, Notification of the First Office Action (on a related application), Aug. 3, 2015.

* cited by examiner

SUPPORTING SPRING SYSTEM FOR A MATTRESS IN PARTICULAR

This patent application claims the benefit of International Patent Application No. PCT/EP2012/004704 having an International Filing Date of 13 Nov. 2012, which claims the benefit of German Patent Application No. 10 2011 118 357.8 having a filing date of 14 Nov. 2011 and German Patent Application No. 10 2012 009 646.1 having a filing date of 15 May 2012.

BACKGROUND OF THE INVENTION

1. Technical Field

The invention relates to a supporting spring system in particular for a mattress of an item of sleeping, sitting or reclining furniture having a plurality of pairs of female multipoint connectors, in each case exhibiting female multipoint connectors oriented parallel to one another, having support elements assigned to the longitudinal members oriented transversely to the female multipoint connectors for the purpose of supporting the female multipoint connectors or the pairs of female multipoint connectors, which support elements exhibit support plates for the mattress and spring arms for the resilient connection of the support plates to the female connectors and/or the pairs of female connectors.

2. Prior Art

The supporting spring system referred to here is an elastic and/or resilient support for mattresses or similar upholstery of beds, bunks, couches, chairs or the like.

Various supporting spring systems of the aforementioned kind are already known. The supporting spring systems differ significantly in respect of their spring characteristics. The spring characteristics have a decisive influence on the sleeping, reclining or sitting comfort of beds, couches, chairs or the like that are provided with such a supporting spring system. Known supporting spring systems support the mattress unevenly.

BRIEF SUMMARY OF THE INVENTION

The object of the invention is to make available, in particular for a mattress of an item of sleeping, sitting or reclining furniture, a supporting spring system which assures improved spring characteristics and more even support of the mattress.

A supporting spring system to accomplish this object a supporting spring system in particular for a mattress for an item of sleeping, sitting or reclining furniture, having a plurality of pairs of female multipoint connectors, in each case exhibiting female multipoint connectors oriented parallel to one another, having support elements assigned to the longitudinal members oriented transversely to the female multipoint connectors for the purpose of supporting the female multipoint connectors or the pairs of female multipoint connectors, which support elements exhibit support plates for the mattress and spring arms for the resilient connection of the support plates to the female connectors and/or the pairs of female connectors, characterized in that the spring arms are guided from beneath the female multipoint connectors of at least a number of pairs of female multipoint connectors and upwards around the outside of the pair of female multipoint connectors. According to this, provision is made for the spring arms to be guided upwards beneath and around the outside of the female multipoint connectors of at least a number of pairs of female multipoint connectors. Whereas it has previously been customary for the spring arms to be guided directly upwards for the purpose of accommodating the mattress, or for the spring arms to be guided between the individual female multipoint connectors of a pair of female multipoint connectors and upwards as far as a common spring plate, the present invention adopts a different approach in that the spring arms are first guided downwards between the female multipoint connectors of each pair of female multipoint connectors and then upwards around the outside of the female multipoint connectors of each pair of female multipoint connectors for the purpose of accommodating the mattress. It is possible in this way to provide relatively long spring arms, which possess a long travel together with largely constant spring characteristics over the travel. The supporting points of the support elements on the under side of the mattress move apart, furthermore, whereby the support for the mattress is distributed more evenly over its surface.

Provision is made, furthermore, for at least one spring arm to be guided upwards around the outside of each female multipoint connector of at least a number of pairs of female multipoint connectors. It is also conceivable, however, for a plurality, preferably two, of spring arms to be guided upwards around each female multipoint connector of at least a number of pairs of female multipoint connectors. The spring effect of the support elements is thus distributed more homogeneously over the entire surface of the mattress, and the spring effect of every individual support element is increased.

In a preferred embodiment of the supporting spring system according to the invention, provision is made for the support elements in each case to exhibit a suspension which extends between the female multipoint connectors of a pair of female multipoint connectors, preferably downwards, and for at least two spring arms to be assigned to the suspension in the region of the respective pair of female multipoint connectors. In this case, the suspension extends between the female multipoint connectors of a pair of female multipoint connectors preferably as far as a point beneath the female multipoint connectors. The spring arms then extend from a lower part of the suspension to the outside in the opposite direction transversely to the female multipoint connectors. With a single suspension, a plurality of spring arms can be connected concurrently to a single pair of female multipoint connectors. In addition, coupling of the spring arms to the respective suspension takes place via the suspension.

According to another advantageous embodiment of the invention, provision is made for a plurality, preferably two, of support plates to be assigned to one outer end of the respective spring arm. For this purpose, provision can be made for these support plates that are assigned to the ends of the respective spring arm to serve as a support surface for the mattress. A particularly even support for the mattress by the support plates is assured by the assignment of a plurality of support plates to each spring arm.

Provision is also made according to the invention for the spring arms with the support plates to be connected in a vertically adjustable manner to the suspension of the support elements. As a result, the spring characteristics of the support elements can be varied individually. A selected area of the mattress can thus be raised, for example, by moving the support elements. The vertical adjustment of the support plates, which are fixed in relation to the spring arms, takes place by a repositioning of the spring arms on the suspension. The spring arms are connected to the suspension in such a way that the spring arms, and preferably all the spring arms of a suspension equally, can be connected in a plurality of positions to the suspension. These positions correspond to different heights of the support plates relative to the female multipoint connectors.

According to a further development of the supporting spring system, provision is made for the suspension of the support elements to exhibit at least two supports, which act on, in particular, are snapped on, the pair of female multipoint connectors from above for the purpose of securing the support elements to the female multipoint connectors. In this case, a support is assigned to each female multipoint connector of the pair of female multipoint connectors concerned. By being latched into position from above, the supports are pressed onto the female multipoint connectors as a load is applied to the support elements and are thus held securely on the same. By means of this latching of the supports into position on the female multipoint connectors, these supports and thus the support elements in their entirety are capable of being displaced along the female multipoint connectors. The supports can also lie freely on the female multipoint connectors, however. Because the supports rest on top of two adjacent female multipoint connectors of a pair of female multipoint connectors, the force which acts from the mattress onto the support plates and the spring arms is transferred onto the pair of female multipoint connectors.

A further embodiment of the invention provides for the connection between the spring arms and the suspension to be formed by a flexible connecting profile section. This connecting profile section is present between the at least two spring arms and the suspension. Because of the special nature of the connecting profile section, the force which acts on one spring arm is transferred in a special way to the other spring arm or to the suspension. Coupled movement of the spring arms can thus be achieved, for example, by the appropriate selection of the connecting profile section. This permits a flexible and individual arrangement of the support elements and thus the spring characteristics of the supporting spring system.

Provision is preferably made for the supports to be capable of being attached to female multipoint connectors exhibiting different flexural strengths in their cross section, whereby the female multipoint connectors are capable of twisting along their longitudinal axis in order to vary the spring characteristics of the support elements. The female multipoint connectors are able to exhibit differing moments of resistance, depending on their orientation (twisting about the longitudinal axis), because of their non-round cross-sectional form or because of a particular choice of material. The female multipoint connectors possess different flexural characteristics, depending on their position relative to the support elements or to the supports, with the result that the support elements differ in respect of their received spring characteristics. This permits further individualization of the deflection properties of the supporting spring system.

It is also proposed according to the invention for a ring, which is rotatably mounted in the suspension, to be assigned in each case to the female multipoint connectors with a non-round cross section. This ring provides a connection or a transition between the non-round cross section of the respective female multipoint connector and the suspension. As a result, twisting of the female multipoint connector together with the ring assigned thereto is made possible in relation to the suspensions. The flexural behavior of the female multipoint connector, and thus the spring effect of the support elements, varies depending on the degree of twisting. The ring in each case can be capable of either manual or motor-driven adjustment.

Furthermore, it is proposed according to the invention for the supporting spring system that the ring assigned to each female multipoint connector is capable of being twisted individually into at least two, and preferably four, positions exhibiting different spring effects. Similarly, the elasticity of all the support elements of the pair of female multipoint connectors can likewise be varied by twisting of the ring assigned to the female multipoint connectors of the respective pair of female multipoint connectors in equal measure. By the single, individual twisting of the ring assigned to only one female multipoint connector of a respective pair of female multipoint connectors, the spring characteristics of the support elements of this pair of female multipoint connectors may differ from one another. This permits the individual and person-specific optimization of the comfort of the supporting spring system.

BRIEF DESCRIPTION OF THE DRAWINGS

Preferred illustrative embodiments of the invention are explained in more detail below on the basis of the drawing. In the drawings.

DETAILED DESCRIPTION OF PREFERRED EMBODIMENTS

Figure 1:
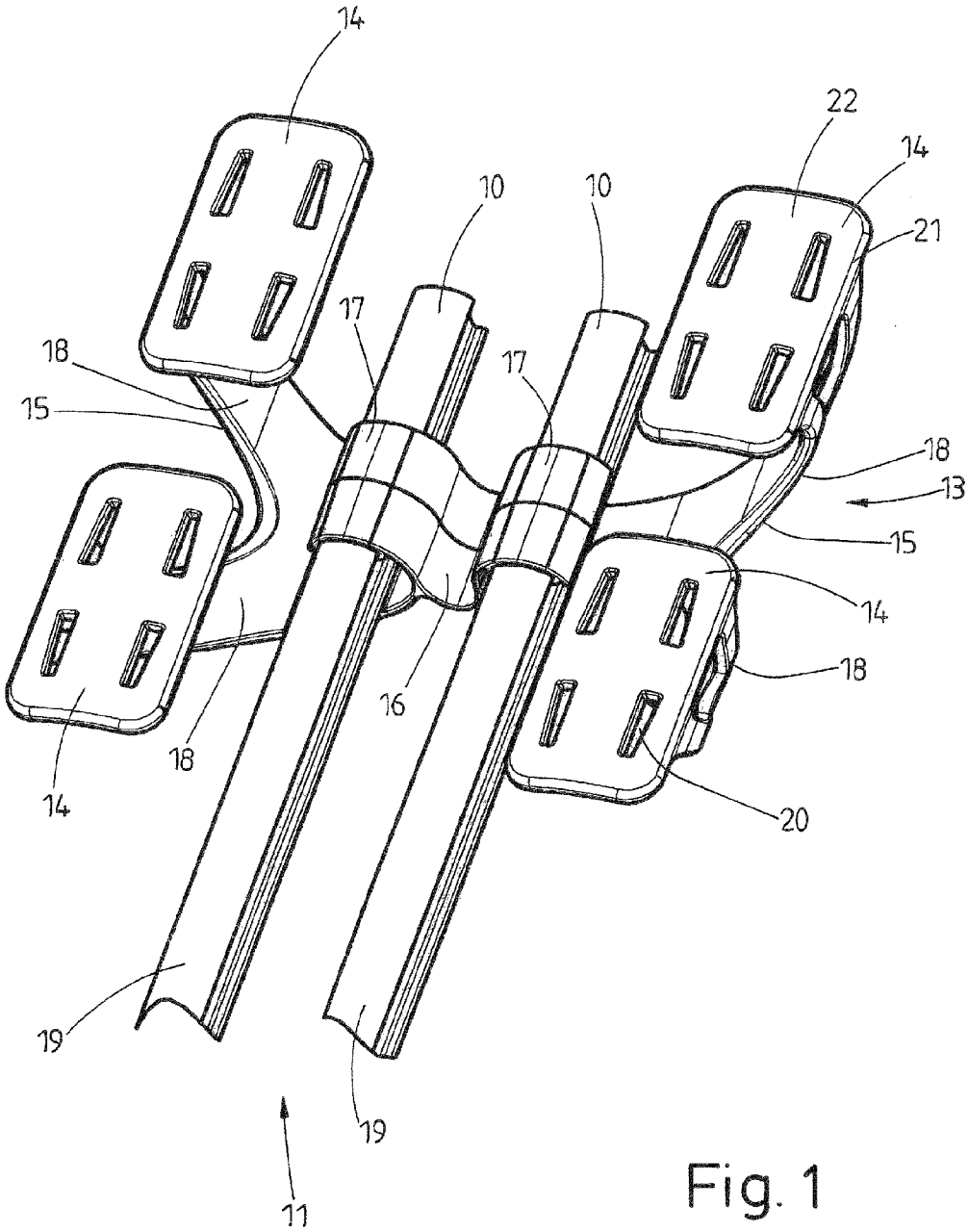
FIG. 1 depicts a perspective representation of a part of a supporting spring system with a support element.

The supporting spring system that is shown only partially in the figures serves as a support for, for example, a mattress (not illustrated here) of a bed or a bunk or a couch.

The supporting spring system exhibits a plurality of preferably identically configured female multipoint connectors 10. Two female multipoint connectors 10 in each case are grouped into a pair of female multipoint connectors 11. The supporting spring system possesses a multiplicity of preferably identically configured pairs of female multipoint connectors 11. The individual female multipoint connectors 10 and the pairs of female multipoint connectors 11 run parallel at a distance from one another. In this case, the distance between two female multipoint connectors 10 of a pair of female multipoint connectors 11 is smaller than the distance between two pairs of female multipoint connectors 11. The distance can also be the same, however. All the female multipoint connectors 10 and all the pairs of female multipoint connectors 11 preferably lie in a common, horizontal plane, although in areas, for example in the head area, in the lumbar area or in the foot area, they may also lie in a different plane and/or be inclined in the longitudinal direction of the supporting spring system.

The female multipoint connectors 10 and the pairs of female multipoint connectors 11 are mounted by their opposite ends on two parallel longitudinal members (not illustrated here). The longitudinal members extend in the longitudinal direction of the supporting spring system or the mattress positioned thereon. In contrast, the female multipoint connectors 10 or the pairs of female multipoint connectors 11 run transversely to the longitudinal members. The longitudinal members are preferably connected to one another by transverse members (not illustrated here), so that the longitudinal members together with the transverse members form a rigid, rectangular frame, such as a bed frame. The female multipoint connectors 10 and the pairs of female multipoint connectors 11 are connected at their opposite ends to the longitudinal members by bearing bodies 12 represented in FIGS. 4 and 5. The bearing bodies 12 are conventionally used to connect the ends of the spring strips 10 or the pairs of spring strips to the longitudinal members in an elastic or articulated manner. The ends of the female multipoint connectors 10 or the pairs of female multipoint connectors 11 can also be attached to the longitudinal members with bearing bodies of any other desired configuration. A rigid connection of the ends of the female multipoint connectors 10 or the pairs of female multipoint connectors 11 to the longitudinal members is also conceivable, however, in the case of the supporting spring system according to the invention.

According to the invention, the female multipoint connectors 10 of the pairs of female multipoint connectors 11 are connected to one another in the area between the longitudinal members. This additional connection is effected by means of support elements 13, 50, 60, 70, 80. FIGS. 1 to 6 show various illustrative embodiments of fully or partially elastic or semi-rigid support elements 13, 50, 60, 70, 80 that are also capable of returning automatically to their original shape after compression. The support elements 13, 50, 60, 70, 80 connect the female multipoint connectors 10 concerned of a pair of female multipoint connectors 11 together. As a result of this, the female multipoint connectors 10 or the pairs of female multipoint connectors 11 act in the form of a spring surface extending continuously over the entire surface of the supporting spring system. Local deflections of the female multipoint connectors 10 or the pairs of female multipoint connectors 11 and, induced thereby, a discontinuous path of the supporting spring system with locally limited depressions are avoided in this way. The support elements 13, 50, 60, 70, 80 lead to local deformations of individual female multipoint connectors 10 or pairs of female multipoint connectors 11, in particular vertical deflection of the female multipoint connectors 10 or the pairs of female multipoint connectors 11, being transmitted to neighboring female multipoint connectors 10 or pairs of female multipoint connectors 11. Neighboring female multipoint connectors 10 or neighboring pairs of female multipoint connectors 11 thus participate in the deflection of individual female multipoint connectors 10 or pairs of female multipoint connectors 11, and preferably only partially. A steady, continuous transition to neighboring female multipoint connectors 10 or pairs of female multipoint connectors 11, and thus an associated deformation of the support elements 13, 50, 60, 70, 80 and/or female multipoint connectors 10 that is uniformly distributed over the surface of the supporting spring system, occurs as a result of this including, in particular, in the event of vertical loadings of individual female multipoint connectors 10 or pairs of female multipoint connectors 11.

The support element 13 represented in FIG. 1 exhibits four support plates 14, two spring arms 15, one suspension 16 and two supports 17. The support element 13 as a whole is executed in a single piece and consists of an elastic material, preferably plastic. However, it can also be made from any other flexible material.

Each pair of female multipoint connectors 11 exhibits a plurality of support elements 13. The supporting spring system as a whole thus has a multiplicity of preferably identical support elements 13.

The support elements 13 are attached to the pairs of female multipoint connectors 11, and preferably between the female multipoint connectors 10 of a pair of female multipoint connectors 11. This attachment is effected in such a way that the support elements 13 are attached either fixed at certain points to the female multipoint connectors 10 of the pair of female multipoint connectors 11 or so as to be capable of sliding displacement on the female multipoint connectors 10 of the pairs of female multipoint connectors 11. The two supports 17 of the support element 13 in this case are each brought into contact with the upper side 19 of the two female multipoint connectors 10 of a pair of female multipoint connectors 11. The elongated curved shape of the supports 17 ensures that they are in positive engagement with the upper side 19 of the female multipoint connectors 10 of the pair of female multipoint connectors 11. The supports 17 thus partially enclose the upper side 19 of the female multipoint connectors 10 of the pair of female multipoint connectors 11. The attachment of the supports 17 to the upper side 19 is effected via either a latched connection, a clamped connection or similar connection mechanisms.

The two supports 17 are connected together via the suspension 16, which extends between the female multipoint connectors 10 of the pair of female multipoint connectors 11. The suspension 16 is capable in this case either of continuing the curved shape of the two supports 17, in which the two supports 17 are joined together in a U-shape, or they can be configured as a web extending downwards between the two female multipoint connectors 10 of the pair of female multipoint connectors 11. The connection between the supports 17 and the suspension 16 is such that the two supports 17 are flexibly in connection with the suspension 16, and preferably merge into one another.

The spring arms 15 are attached in addition to the suspension 16. The two spring arms 15 extend starting from the suspension 16 and continuing the shape of the curved supports 17 between the two female multipoint connectors 10 of the pair of female multipoint connectors 11 concerned in opposite directions and transversely to the female multipoint connectors 10 below and around the female multipoint connectors 10 of the pair of female multipoint connectors 11 to the outside; similar in form to the Greek letter Ω (omega). The two spring arms 15 in this case have a bent shape, whereby the spring arms 15 extend from beneath the pair of female multipoint connectors 11 in opposite directions outwards and then upwards, so that they reach beyond the upper sides 19 of the female multipoint connectors 10. As a result of this, the spring arms 15 are guided from the under side of the pair of female multipoint connectors 11 in a mirror-image path externally around the two parallel female multipoint connectors 10. The spring arms 15 are attached to the suspension 16 in such a way that they are capable of flexible movement up and down. In this case, the two spring arms 15 extending in opposite directions are capable of being moved independently of one another. The two spring arms 15 are also connected to one another via their common suspension 16, however, in such a way that their spring movements are able to correspond, and in particular that the spring movements are partially transferred.

Each of the spring arms 15 is divided or is branched into two spring arm parts 18, which in turn extend upwards inclined away from one another. Each spring arm part 18 is connected at its free end in a single piece to one of the support plates 14.

The support plates 14 at each end of the four spring arm parts 18 constitute flat plates, which are aligned parallel to the plane formed by the female multipoint connectors 10 or the pairs of female multipoint connectors 11 and are situated at a distance above this plane. The four support plates 14 are identical in shape, although they may also differ in their nature. The support plates 14 exhibit holes 20 for material and weight reduction. The spring arm parts 18 are attached on one longitudinal side 21 of the support plates 14. The free longitudinal side situated opposite the longitudinal side 21 faces towards the pair of female multipoint connectors 11. However, the support plates 14 may adopt any other orientation.

The surfaces 22 of the individual support plates 14 are constructed in such a way that they are able to accommodate the mattress. The under side of the mattress in this case enters into contact with the surfaces 22 of the support plates 14. As a result, the weight force of the mattress is transferred to the surface 22 and thus to the support plates 14 or to the entire support element 13. The weight force of the mattress acting on the individual support plates 14 is reduced by virtue of the fact that, in the present illustrative embodiment, four support plates 14 are assigned to the support element. The weight force of the mattress acting on the surface 22 of the support plates 14 is transferred evenly onto the spring arms 15 of the support elements 13. The spring arms 15 act against the weight force of the mattress in a resilient manner. The spring arms 15 move up and down depending on the weight of the mattress, or after imposing the load on the mattress and after removing the load from the mattress. If no force acts on the support plates 14, the support elements move back to their starting position. The support element 13 can absorb or counteract local loadings on the mattress by virtue of the fact that the present illustrative embodiment of the support element 13 exhibits four support plates 14, each having a spring arm 18. The spring force transferred to the spring arms 15 by the weight force of the mattress is transferred further to the female multipoint connectors 10 of the pair of female multipoint connectors 11. This results in light cushioning of the entire supporting spring system, extending across all areas, which leads to increased sleeping comfort. The support elements 13 can be displaced freely on the female multipoint connectors 10 of the pair of female multipoint connectors 11 in accordance with the user's personal wishes and requirements.

Figure 2:
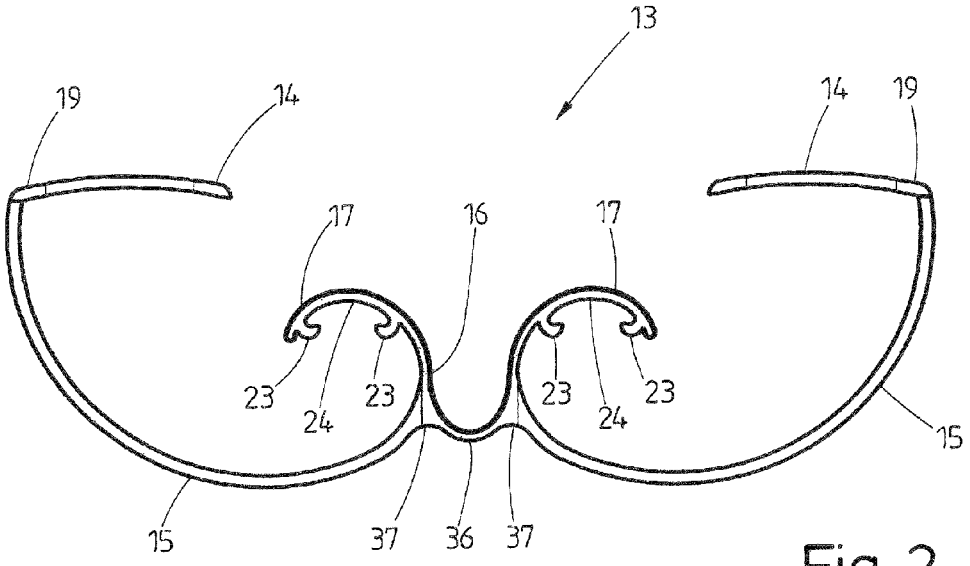
FIG. 2 depicts a side view of the support element in FIG. 1.

A side view of the support element 13 is represented in FIG. 2. The support element 13 can be attached in fixed positions in order to ensure that the support elements 13 can be secured to the female multipoint connectors 10 of the pair of female multipoint connectors 11 and do not slide unintentionally along the female multipoint connectors 10. Latching means 23, which are present on the under sides 24 of the two supports 17, are used for these attachments. The latching means 23 are configured as hooks, which extend parallel to the female multipoint connectors 10 along the support 17. The latching means 23 are brought into connection with their counterparts (not illustrated here) on the female multipoint connectors 10 for the purpose of attaching the supports 17 to the female multipoint connectors 10. This connection can be constructed in such a way that the support elements 13 are assigned to a fixed location on the female multipoint connectors 10 or remain capable of being displaced along the female multipoint connectors 10. The latching means 23 prevent not only easy slipping along the female multipoint connectors, but also twisting of the support elements 13 about the female multipoint connectors 10 of the pair of female multipoint connectors 11.

In order further to strengthen the connection of the spring arms 15 to the suspension 16, the illustrative embodiment depicted in FIG. 2 exhibits an additional web 37 in each case between each spring arm 15 and the U-shaped lower part 36 of the suspension 16. The spring force acting on the spring arms 15 is transferred additionally by the webs 37 onto the U-shaped lower part 36 of the suspension 16. The two spring arms 15 are able to communicate with one another through the U-shaped lower part 36 of the suspension and through the webs 37, that is to say the spring effect of one of the spring arms 15 is transferred to the other spring arm 15.

Figure 3:
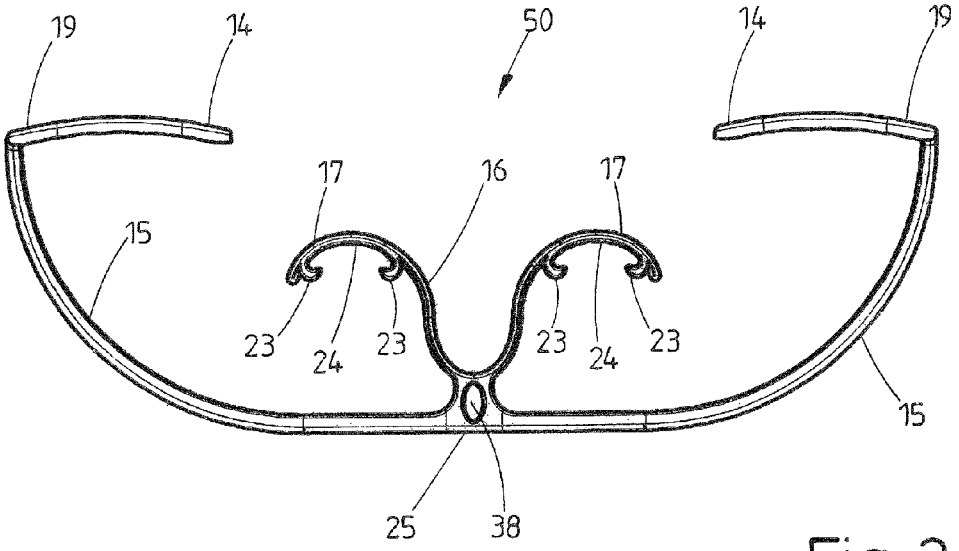
FIG. 3 depicts a side view of an alternative embodiment of the support element.

Represented in FIG. 3 is a side view of a further illustrative embodiment of a support element 50, which has been slightly modified compared to the support element 13 represented in FIG. 1 and FIG. 2. For reasons of simplicity, equivalent components to those in the embodiment in FIG. 1 and FIG. 2 are provided with identical reference numbers in this case.

The support element 50 represented in FIG. 3 exhibits a connecting profile section 25, which connects the spring arms 15 to the suspension 16, and imparts special spring characteristics to the support element 13 as a result. The connecting profile section 25 is integral with the lower part 36 of the suspension 16 on the one hand, and is connected to the two spring arms 15 that are joined together. In this case, the spring arms 15 and the suspension 16 together form a shape, which resembles that of the inverted upper-case letter "T". The connecting profile section 25 acquires special spring characteristics through a tunnel-shaped oval 38. The spring arms 15 act together in a resilient manner as a result of this special embodiment of the connecting profile section 25. In the event of the one-sided loading of the support element 50 by a single spring arm 15, this loading acts via the connecting profile section 25 on the other spring arm 15. The spring effects of the two spring arms 15 are thus coupled together through this connecting profile section 25. Embodiments of the connecting profile section 25 are also conceivable, however, which counteract the coupling of the two spring arms 15. The spring effect of the entire support member 50 can thus be preset by the appropriate choice of the connecting profile section 25. It is conceivable, for example, for the support elements 50 to exhibit different connecting profile sections 25 in the head area, the foot area or the lumbar area, since these areas are subjected to a different loading.

Figure 4:
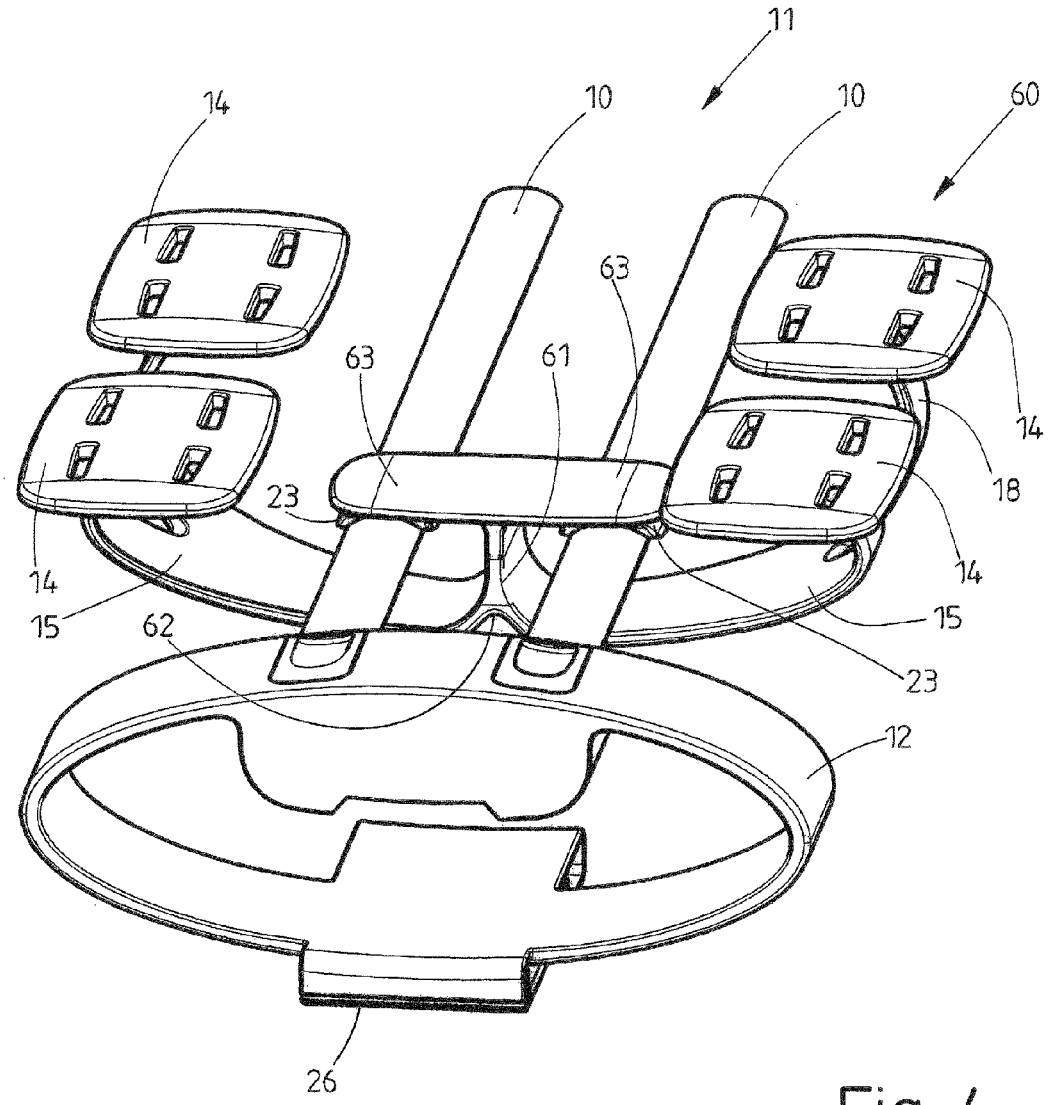
FIG. 4 depicts a perspective representation of a part of a supporting spring system having a support element and a bearing body according to a further illustrative embodiment of the invention.

Represented in FIG. 4 is a perspective view of a support element 60 according to a further illustrative embodiment. The support element 60 is also attached to a pair of female multipoint connectors 11. For reasons of simplicity, equivalent components to those in the embodiment in FIG. 1 to FIG. 3 are provided with identical reference numbers in this case.

A suspension 61 represented in FIG. 4 is of web-shaped configuration and extends downwards between the female multipoint connectors 10 of the pair of female multipoint connectors 11. The two spring arms 15 emerge in a single piece from a lower part 62 of the suspension 61. A support 63 is attached integrally to the end opposite the lower part 62 of the suspension 61. This support 63 is of planar configuration transversely to the female multipoint connectors 10 and extends over the two female multipoint connectors 10 of the pair of female multipoint connectors 11. The supports 63 are connected to the female multipoint connectors 10 via latching means 23 as described for the support element 13. The spring arms 15 are secured centrally beneath the support plates 14 in the illustrative embodiment of a support element 60 represented in FIG. 4.

The pairs of female multipoint connectors 11 are connected at their opposite ends (only one end is depicted here) to a bearing body 12 in the illustrative embodiment of a support element 60 represented in FIG. 4. The bearing body 12 represented in FIG. 4 is likewise configured as a spring and is capable of absorbing spring forces acting on the female multipoint connectors 10. The bearing body 12 is attached via its connecting means 26 to a member (not illustrated here) of a sitting or sleeping arrangement or the like. The supporting spring system as a whole exhibits a plurality of such bearing bodies 12 interacting with the pairs of female multipoint connectors 11. The bearing bodies can adopt any other desired form in addition to the illustrative embodiment of the bearing body 12 represented here. However, the female multipoint connectors 10 or the pairs of female multipoint connectors 11 can also be connected directly to the members, preferably the longitudinal members.

Figure 5:
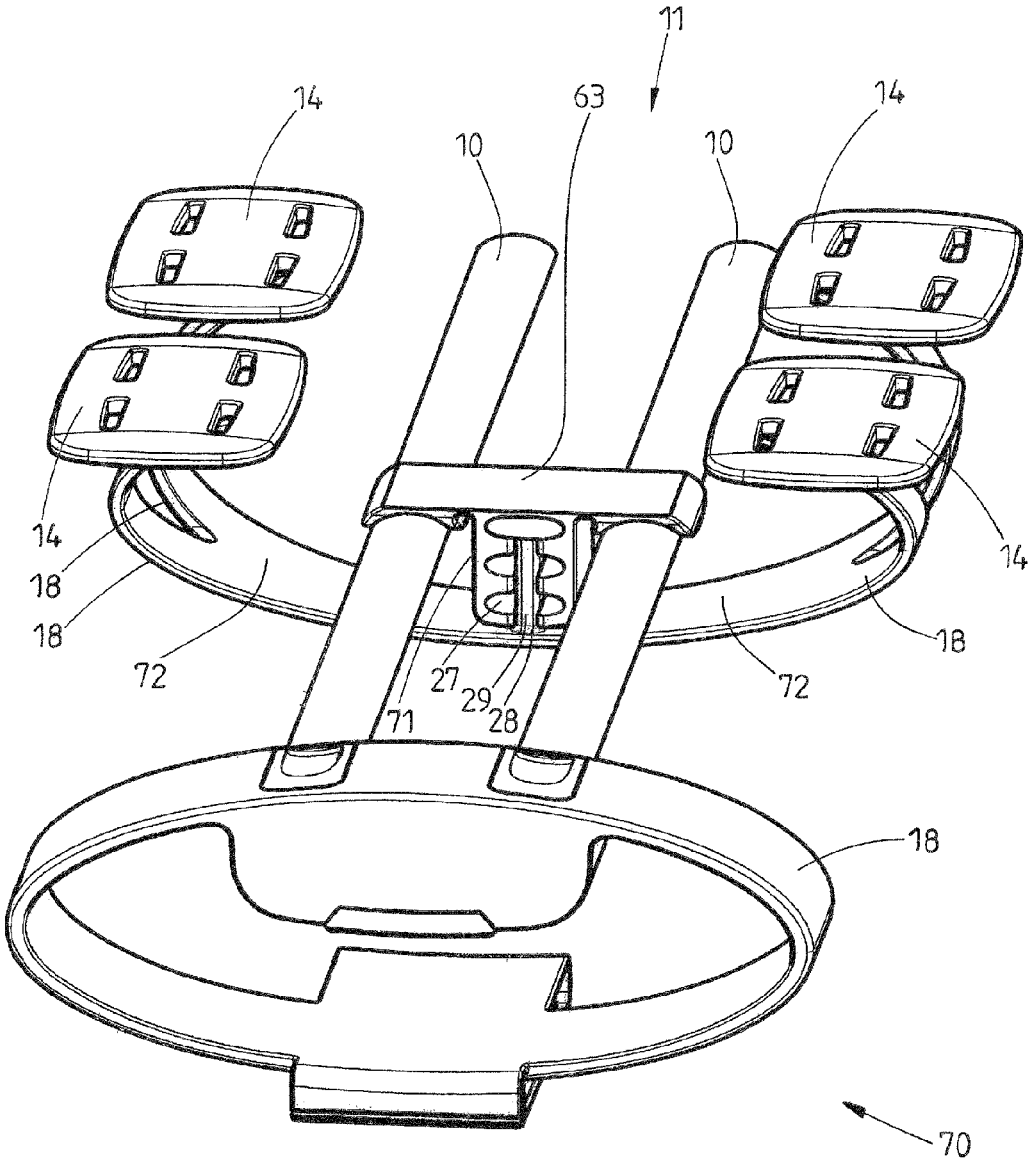
FIG. 5 depicts a perspective representation of a support element capable of vertical adjustment.

Represented in FIG. 5 is a further illustrative embodiment of a support element 70, which is connected to the female multipoint connectors 10 of a pair of relevant female multipoint connectors 11. For reasons of simplicity, equivalent components to those in the embodiment in FIGS. 1 to 4 are provided with identical reference numbers in this case.

The illustrative embodiment of a support element 70 represented here is adjustable in respect of its height relative to the plane formed by the pair of female multipoint connectors 11. The two spring arms 15 with the support plates 14 are moved up or down relative to the support 63 for this purpose. The suspension 71 that is connected integrally to the support 63 possesses a number of special features for this vertical adjustment. The suspension 71 represented in FIG. 5 exhibits three oval recesses 27, which extend through the suspension 71 one above the other parallel to the female multipoint connectors 10. It is also conceivable, however, to provide more than three or fewer than three recesses 27. In turn, the illustrative embodiment of the spring arms 72 represented in FIG. 5 exhibits a T-piece 28, which is connected in a single piece to the spring arms 72. This T-piece 28 consists of a web 29, at the upper end of which there is arranged an oval head part 30 corresponding to the recesses 27 in the suspension 71. The head part 30 of the T-piece 28 is constructed in such a way that it fits precisely into one of the three identical recesses 27 in the suspension 71. The two spring arms are thus connected securely to the suspension 71 via the web 29.

In order to vary the relative height between the spring arms 72 and the supports 63, the spring arms 72 are capable of displacement parallel to the pair of female multipoint connectors 11, so that the head part 30 of the T-piece 28 moves out of the recess 27 and, depending on the corresponding desired height, can be reintroduced into one of the other recesses 27. The support element 70 is thus capable of vertical adjustment into three discrete positions. The special requirements and wishes of the user of the mattress can thus be met by this individual vertical adjustment of each support element 70.

Figure 6:
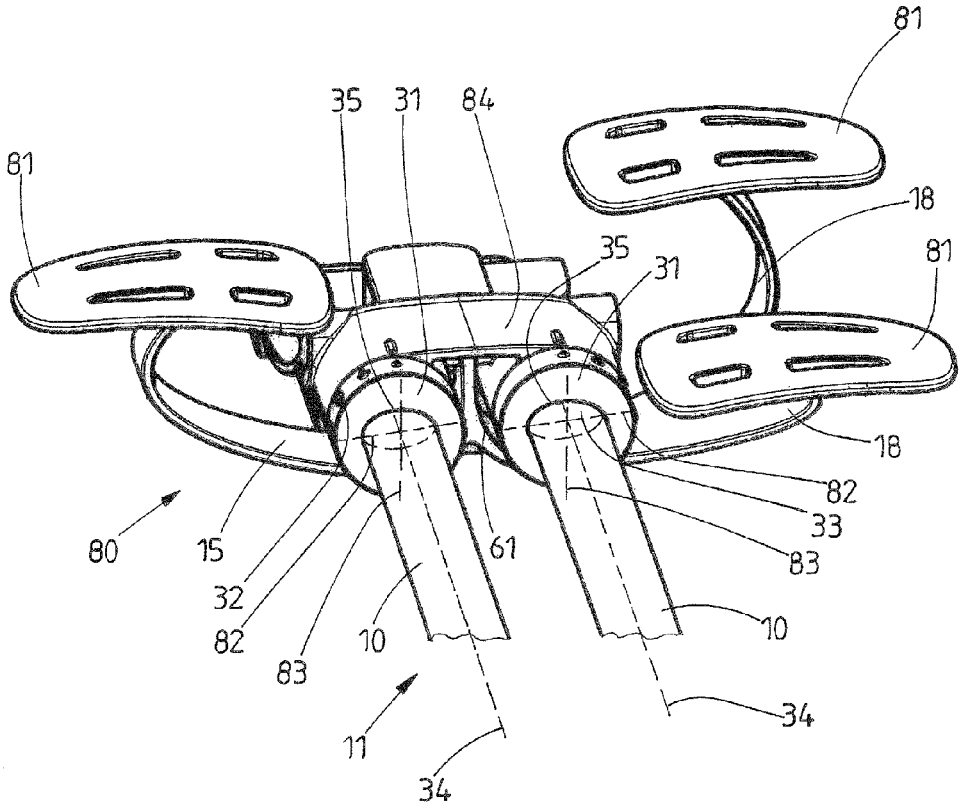
FIG. 6 depicts a perspective representation of a support element having twistable female multipoint connectors.

The illustrative embodiment of a support element 80 represented in FIG. 6 is similar in construction to the support elements in FIG. 1 to FIG. 5. For reasons of simplicity, equivalent components to those in the embodiment in FIG. 1 to FIG. 5 are provided with identical reference numbers in this case.

The illustrative embodiment of a support element 80 represented in FIG. 6 exhibits only three support plates 81. It is not intended, however, that the illustrative embodiment represented here should be restricted to this.

In order to vary the spring effect of the supporting spring system, the spring characteristics of the individual female multipoint connectors 10 can be changed. For this purpose, the female multipoint connectors 10 exhibit different materials with different flexural characteristics, for example in the longitudinal direction. In the illustrative embodiment represented here, the female multipoint connectors 10 possess a non-round cross section 33. This non-round cross section is elliptical with a long axis 82 and a short axis 83 in the depicted illustrative embodiment. Its flexural strength can be varied by twisting about its longitudinal axis 34 as a result of this non-round cross section 33 of the female multipoint connectors 10. The female multipoint connectors 10 exhibit a soft or hard flexural behavior depending on how the female multipoint connectors 10 are twisted about their longitudinal axis 34.

If the non-round female multipoint connectors 10 are twisted along their longitudinal axis 34 in such a way that the long axis 82 of the female multipoint connectors 10 is oriented perpendicular to the plane formed by the pair of female multipoint connectors 11, the female multipoint connectors 10 will exhibit high flexural strength under loading. If, on the other hand, the non-round female multipoint connectors 10 are twisted along their longitudinal axis 34 in such a way that the short axis 83 of the female multipoint connectors 10 is oriented perpendicular to the plane formed by the pair of female multipoint connectors 11, the female multipoint connectors 10 will oscillate relatively softly under loading.

In order for the non-round female multipoint connectors 10 or pairs of female multipoint connectors 11 exhibiting a non-round cross section 33 to be capable of being twisted relative to the support element 80, a ring 31 is assigned to each female multipoint connector 10 of the pair of female multipoint connectors 11 in the region of each support element 80. The rings 31 each exhibit a non-round seat 35, with which the non-round female multipoint connectors 10 can be received with positive engagement. In addition, the rings 31 each exhibit a round connecting part (not illustrated here), which are supported rotatably about the longitudinal axis 34 with positive engagement in recesses in the support 84 for the support element 80. The support 84 is configured in such a way that it encloses the round connecting parts of the rings 31.

The non-round female multipoint connectors 10 are thus in a rotatable connection with the support element 80 via the rings 31.

Indicated in FIG. 6 are four positions 32, into which the female multipoint connectors 10 of the pair of female multipoint connectors 11 can be rotated. These four positions 34 correspond to various spring characteristics of the female multipoint connectors 10.

The rotation of the two rings 31 of the support elements 80 can take place jointly or separately, manually or automatically via a motor drive. The spring effect can be set in a manner specific to a particular area by the individual setting of the flexural strength of the individual female multipoint connectors 10. Various spring effects can thus be set for the head, lumbar and/or foot area by rotating the female multipoint connectors 10 of only certain pairs of female multipoint connectors 11.

LIST OF REFERENCE DESIGNATIONS

10 female multipoint connector
11 pair of female multipoint connectors
12 bearing body
13 support element
14 support plate
15 spring arm
16 suspension
17 support
18 spring arm part
19 upper side
20 hole
21 longitudinal side
22 surface
23 latching means
24 under side
25 connecting profile section
26 connecting means
27 recess

28 T-piece
29 web
30 head part
31 ring
32 position
33 cross section
34 longitudinal axis
35 seat
36 lower part
37 web
38 oval
50 support element
60 support element
61 suspension
62 lower part
63 support
70 support element
71 suspension
72 spring arm
80 support element
81 support plate
82 long axis
83 short axis
84 support

The invention claimed is:

1. A supporting spring system for a mattress for an item of sleeping, sitting or reclining furniture, having:

a plurality of pairs of female multipoint connectors (11) having female multipoint connectors (10) oriented parallel to one another;

longitudinal members oriented transversely to the female multipoint connectors (10);

support elements (13, 50, 60, 70, 80) that cooperate with the longitudinal members oriented transversely to the female multipoint connectors (10) for the purpose of supporting the female multipoint connectors (10) or the pairs of female multipoint connectors (11), which support elements exhibit support plates (14, 81) for the mattress and spring arms (15, 72) for the resilient connection of the support plates (14, 81) to the female connectors (10) and/or the pairs of female multipoint connectors (11), wherein the spring arms (15, 72) are guided from beneath the female multipoint connectors (10) of at least a number of the pairs of female multipoint connectors (11) and upwards around the outside of the pairs of female multipoint connectors (11), wherein the support elements (13, 50, 60, 70, 80) have a suspension (16, 61, 71), which extends between the female multipoint connectors (10) of a pair of female multipoint connectors (11), wherein at least one spring arm (15, 72) cooperates with the suspension (16, 61, 71), wherein the suspension (16, 61, 71) extends downwards between the female multipoint connectors (10) of the pair of female multipoint connectors (11), wherein the suspension (16, 61, 71) exhibits at least two supports (17, 63, 84), which act on the pair of female multipoint connectors (11) from above for the purpose of securing the support elements (13, 50, 60, 70, 80) to the female multipoint connectors (10), and wherein the at least two supports (17, 63, 84) are connected to the female multipoint connectors (10) and the female multipoint connectors (10) exhibit different flexural strength in their cross section (33) in such a way that the female multipoint connectors (10) is twistable in order to vary the spring characteristics of the support elements (13, 50, 60, 70, 80).

2. The supporting spring system as claimed in claim 1, wherein at least one of the spring arms (15, 72) is guided upwards around the outside of each of the female multipoint connectors (10) of at least a number of the pairs of female multipoint connectors (11).

3. The supporting spring system as claimed in claim 1, wherein a plurality of the support plates (14, 81) cooperate with one outer end of the respective spring arm (15, 72).

4. The supporting spring system as claimed in claim 1, wherein the spring arms (15, 72) with the support plates (14, 81) are connected in a vertically adjustable manner to the suspension (16, 61, 71) of the support elements (13, 50, 60, 70, 80).

5. The supporting spring system as claimed in claim 4, wherein the connection between the spring arms (15, 72) and the suspension (16, 61, 71) is formed by a flexible connecting profile section (25).

6. The supporting spring system as claimed in claim 1, wherein the support elements (13, 50, 60, 70, 80) are latched in place to the female multipoint connectors (10).

7. The supporting spring system as claimed in claim 1, wherein at least one ring (31), which is rotatably mounted in the suspension (16, 61, 71), cooperates with the pair of female multipoint connectors (11) with a non-round cross section (33).

8. The supporting spring system as claimed in claim 7, wherein the at least one ring (31) cooperates with each of the female multipoint connectors (10) and is twistable individually into at least two positions (32) exhibiting different spring effects.

9. The supporting spring system as claimed in claim 7, wherein the at least one ring (31) that cooperates with each of the female multipoint connectors (10) is twistable individually into four positions (32) exhibiting different spring effects.

10. The supporting spring system as claimed in claim 1, wherein two of the support plates (14, 81) are attached to one outer end of the respective spring arm (15, 72).

11. A supporting spring system for a mattress for an item of sleeping, sitting or reclining furniture, having:

a plurality of pairs of female multipoint connectors (11) having female multipoint connectors (10) oriented parallel to one another;

longitudinal members oriented transversely to the female multipoint connectors (10);

support elements (13, 50, 60, 70, 80) that cooperate with the longitudinal members oriented transversely to the female multipoint connectors (10) for the purpose of supporting the female multipoint connectors (10) or the pairs of female multipoint connectors (11), which support elements exhibit support plates (14, 81) for the mattress and spring arms (15, 72) for the resilient connection of the support plates (14, 81) to the female connectors (10) and/or the pairs of female multipoint connectors (11), wherein the spring arms (15, 72) are guided from beneath the female multipoint connectors (10) of at least a number of the pairs of female multipoint connectors (11) and upwards around the outside of the pairs of female multipoint connectors (11), wherein the support elements (13, 50, 60, 70, 80) have a suspension (16, 61, 71), which extends between the female multipoint connectors (10) of a pair of female multipoint connectors (11), wherein at least one spring arm (15, 72) cooperates with the suspension (16, 61, 71), wherein the suspension (16, 61, 71) extends downwards between the female multipoint connectors (10) of the pair of female multipoint connectors (11), and wherein at least one ring (31), which is rotatably mounted in the suspension (16, 61, 71), cooperates with the pair of female multipoint connectors (11) with a non-round cross section (33).

* * * * *